US010400387B2

(12) United States Patent
Thompson

(10) Patent No.: US 10,400,387 B2
(45) Date of Patent: Sep. 3, 2019

(54) PORTABLE FABRIC CUTTING DEVICE

(71) Applicant: Mandee Thompson, Fairfield, OH (US)

(72) Inventor: Mandee Thompson, Fairfield, OH (US)

( * ) Notice: Subject to any disclaimer, the term of this patent is extended or adjusted under 35 U.S.C. 154(b) by 0 days.

(21) Appl. No.: 15/828,697

(22) Filed: Dec. 1, 2017

(65) Prior Publication Data

US 2018/0155867 A1 Jun. 7, 2018

Related U.S. Application Data

(60) Provisional application No. 62/428,723, filed on Dec. 1, 2016.

(51) Int. Cl.

| | |
|---|---|
| ***D06H 7/00*** | (2006.01) |
| ***B26B 29/06*** | (2006.01) |
| *B26D 7/28* | (2006.01) |
| *B26D 7/00* | (2006.01) |
| *B26D 1/04* | (2006.01) |

(52) U.S. Cl.

CPC ..... *D06H 7/00* (2013.01); *B26B 29/06* (2013.01); *B26D 1/045* (2013.01); *B26D 7/0006* (2013.01); *B26D 7/28* (2013.01)

(58) Field of Classification Search

CPC ..... D06H 7/00; B26B 29/06; B26D 1/045; B26D 7/0006; B26D 7/28

See application file for complete search history.

(56) References Cited

U.S. PATENT DOCUMENTS 27,959 A * 4/1860 Barraud ..... B26D 1/553 83/597
1,374,139 A * 4/1921 Denniss ..... A63F 3/00895 273/280
2,187,574 A * 1/1940 Nigra ..... B43L 5/00 33/430
2,255,812 A * 9/1941 Rickman ..... B26D 1/305 30/229
2,388,402 A * 11/1945 Fry ..... B25H 7/00 33/482
3,077,805 A * 2/1963 Stanley ..... B26D 7/025 269/233
3,301,117 A * 1/1967 Spaulding ..... B26D 1/105 83/455
3,492,538 A * 1/1970 Fergusson ..... H01R 12/79 361/749
3,871,079 A * 3/1975 Magee ..... B26B 29/06 30/294
4,258,893 A * 3/1981 Tolley ..... B43L 5/02 108/28
4,375,296 A * 3/1983 Chang ..... B43L 3/004 211/45
4,470,201 A * 9/1984 Lindquist ..... A41H 31/00 33/2 H
4,497,477 A * 2/1985 Abel ..... C03B 33/04 269/303
4,505,039 A * 3/1985 Donovan ..... B26B 29/06 269/295

(Continued)

*Primary Examiner* — Sean M Michalski
(74) *Attorney, Agent, or Firm* — Jenei LLC

(57) ABSTRACT

A fabric cutting board includes a rectangular board having an integral scissor guide formed across an upper surface. Measurement grid is presented on the upper surface. At least two clips are sized to grip a lateral edge of the rectangular board, clamping a layer of fabric against the upper surface.

8 Claims, 6 Drawing Sheets

(56) References Cited

U.S. PATENT DOCUMENTS 4,903,409 A * 2/1990 Kaplan ..... B26B 5/005 30/293
4,939,968 A * 7/1990 Stoof ..... B26D 7/015 269/303
4,957,025 A * 9/1990 Beno ..... B26D 1/30 83/468
5,050,306 A * 9/1991 Renaud ..... B26B 5/005 30/293
5,203,548 A * 4/1993 Sanders ..... A47J 47/005 269/289 R
5,307,717 A * 5/1994 Winston ..... B65H 35/002 30/124
5,653,035 A * 8/1997 Chen ..... B26B 29/06 33/1 K
5,722,174 A * 3/1998 Repp ..... A41H 3/00 33/11
D394,407 S * 5/1998 Meisner ..... D10/64
5,845,409 A * 12/1998 Kimoto ..... B43L 5/02 33/437
5,901,763 A * 5/1999 You ..... B23D 47/025 144/286.1
D430,811 S * 9/2000 DeVos ..... D10/71
6,182,549 B1 * 2/2001 Albright ..... B26D 7/015 269/303
6,199,495 B1 * 3/2001 Schafer ..... D05C 17/00 112/409
6,200,212 B1 * 3/2001 Henry ..... A01K 97/04 43/56
6,216,354 B1 * 4/2001 Carbone ..... B43L 13/20 33/27.01
6,298,800 B1 * 10/2001 Gala ..... D05C 9/04 112/103
6,789,792 B1 * 9/2004 Angland ..... A47J 47/005 269/289 R
6,829,833 B2 * 12/2004 Langman ..... B43L 7/00 33/32.2
6,839,971 B2 * 1/2005 Schafer ..... B26B 29/06 33/1 B
7,059,952 B1 * 6/2006 McRoberts ..... A22C 25/06 452/105
7,231,720 B2 * 6/2007 Allen ..... B25H 7/04 33/41.6
7,464,480 B2 * 12/2008 Vetromila ..... G01B 3/04 33/1 G
7,536,803 B2 * 5/2009 Samuels ..... B26B 15/00 30/289
D624,791 S * 10/2010 Caputo ..... D7/672
8,141,860 B2 * 3/2012 Goldman ..... A47J 47/005 269/285
8,701,303 B1 * 4/2014 Hales ..... B31F 1/08 33/566
9,021,711 B2 * 5/2015 Segreti ..... B43L 5/02 33/1 G
9,138,904 B2 * 9/2015 Thomas ..... B26B 29/06
9,504,355 B2 * 11/2016 Lee ..... A47J 37/101
9,795,236 B2 * 10/2017 Smallman ..... B65D 1/34
10,143,253 B2 * 12/2018 Faupel ..... A41H 3/00
2003/0093910 A1 * 5/2003 Chang ..... B43L 13/205 33/566
2005/0188808 A1 * 9/2005 Parrish ..... B26D 7/015 83/522.11
2005/0252019 A1 * 11/2005 Gordon ..... B43L 13/20 33/566
2006/0005684 A1 * 1/2006 Cox ..... B26D 1/30 83/607
2006/0027062 A1 * 2/2006 Whaley ..... B26B 29/06 83/13
2006/0240758 A1 * 10/2006 Sorey ..... A22C 25/025 452/195
2008/0241802 A1 * 10/2008 Hachey ..... G09B 11/04 434/90
2009/0151531 A1 * 6/2009 Levin ..... B26B 5/00 83/565
2010/0084848 A1 * 4/2010 Nguyen ..... B42F 9/001 281/49
2014/0202086 A1 * 7/2014 Reese ..... E04D 13/076 52/12
2017/0265489 A1 * 9/2017 Statham ..... B08B 3/02

* cited by examiner

PORTABLE FABRIC CUTTING DEVICE

CROSS-REFERENCE TO RELATED APPLICATIONS

This application claims the benefit of priority under 35 U.S.C. § 119(e) to U.S. Provisional Application Ser. No. 62/428,723 entitled "Portable Fabric Cutting Table," filed 1 Dec. 2016, the contents of which are incorporated herein by reference in their entirety.

BACKGROUND OF THE INVENTION

1. Field of the Invention

The field of art disclosed herein pertains to portable fabric cutting platforms.

DESCRIPTION OF THE RELATED ART

Currently there is no easy, compact fabric cutting table to assist non-professional/"do it yourselfers"/DIY'er with cutting fabric straight. There are professional fabric cutting tables that are large and expensive. These are not space friendly for the typical home owner; they require large spaces to use, and no easy way to store them when not in use.

BRIEF DESCRIPTION OF THE FIGURES

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

The present disclosure provides in one aspect a fabric cutting board that includes a rectangular board having an integral scissor guide formed across an upper surface; measurement grid presented on the upper surface; and at least two clips sized to grip a lateral edge of the rectangular board, clamping a layer of fabric against the upper surface.

In one or more embodiments, the rectangular board has a main panel including the V-channel scissor guide. A first folding panel is hingedly attached to the main panel to move between: (i) a compact position folded against the main panel; and (ii) an open position extending outward away from the main panel.

In one or more embodiments, a floating hinge is hingedly attached between the main panel and the first folding panel, wherein the first folding panel is movable between (i) a first compact position folded on top of the main panel; (ii) a second compact position folded beneath the main panel; and (iii) the open position extending outward away from the main panel.

In one or more embodiments, a second folding panel is hingedly attached to an opposite lateral side of the main panel to move between: (i) a compact position folded against the main panel; and (ii) an open position extending outward away from the main panel.

In another aspect of the present disclosure, a fabric cutting board includes a rectangular board having an integral V-shaped scissor guide formed across an upper surface. Left and right panels are attached longitudinally along each side of the integral V-shaped scissor guide. Each panel is sloped from a height of the integral V-shaped scissor guide down to a mat thickness. At least an outer longitudinal edge of each panel and a longitudinal central low point of the integral V-shaped scissor guide are supportable on a horizontal surface. In one or more embodiments, a fabric mat positioned against the outer longitudinal edge of a selected one of the left and right panels.

Turning now to the Drawings, the detailed description set forth below in connection with the appended drawings is intended as a description of various configurations and is not intended to represent the only configurations in which the concepts described herein may be practiced. The detailed description includes specific details for the purpose of providing a thorough understanding of various concepts with like numerals denote like components throughout the several views. However, it will be apparent to those skilled in the art that these concepts may be practiced without these specific details. In some instances, well known structures and components are shown in block diagram form in order to avoid obscuring such concepts.

Figure 1:
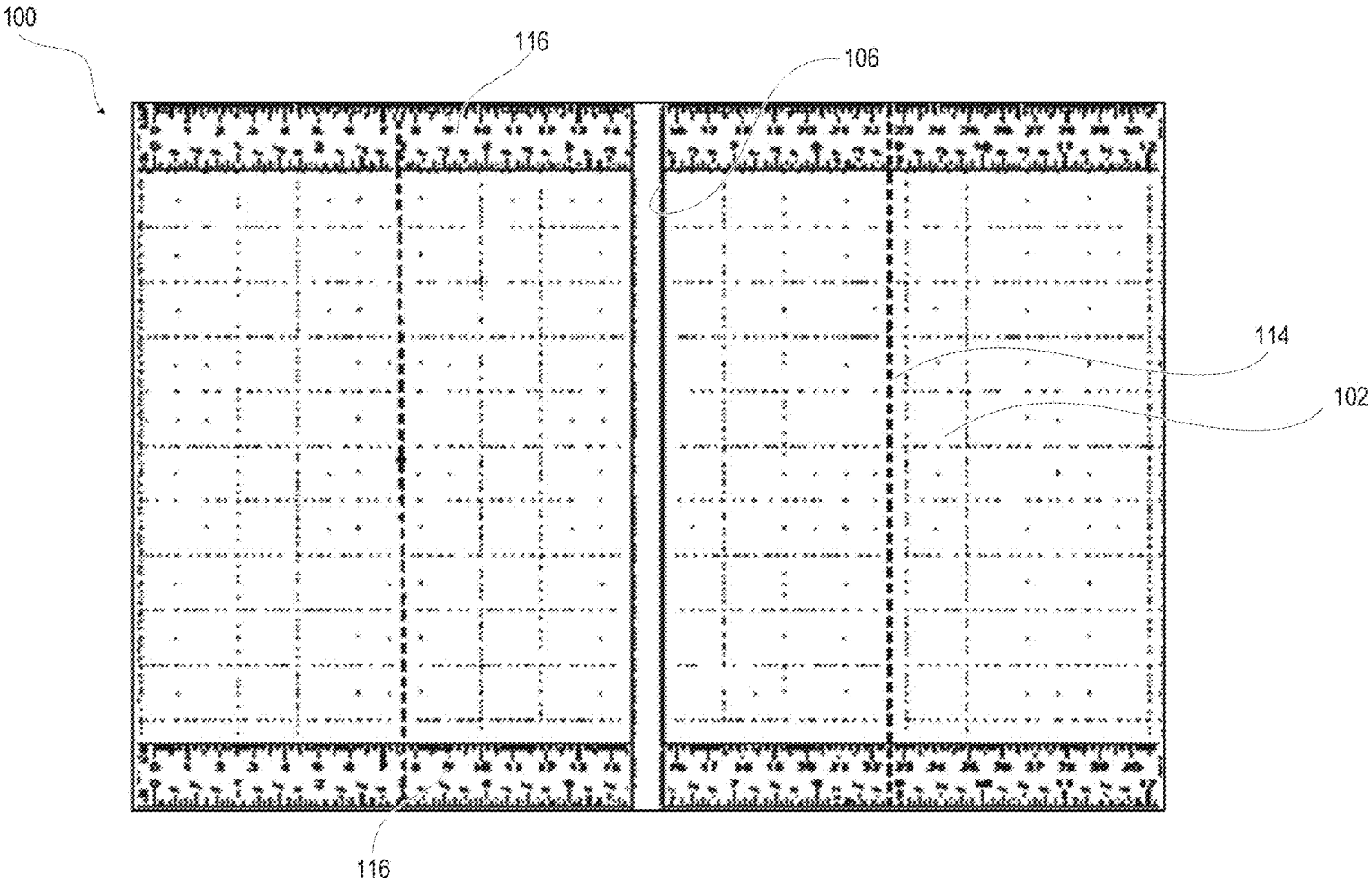
FIG. 1 illustrates a top view of a foldable, tabletop fabric cutting table, according to one or more embodiments.
Figure 2:
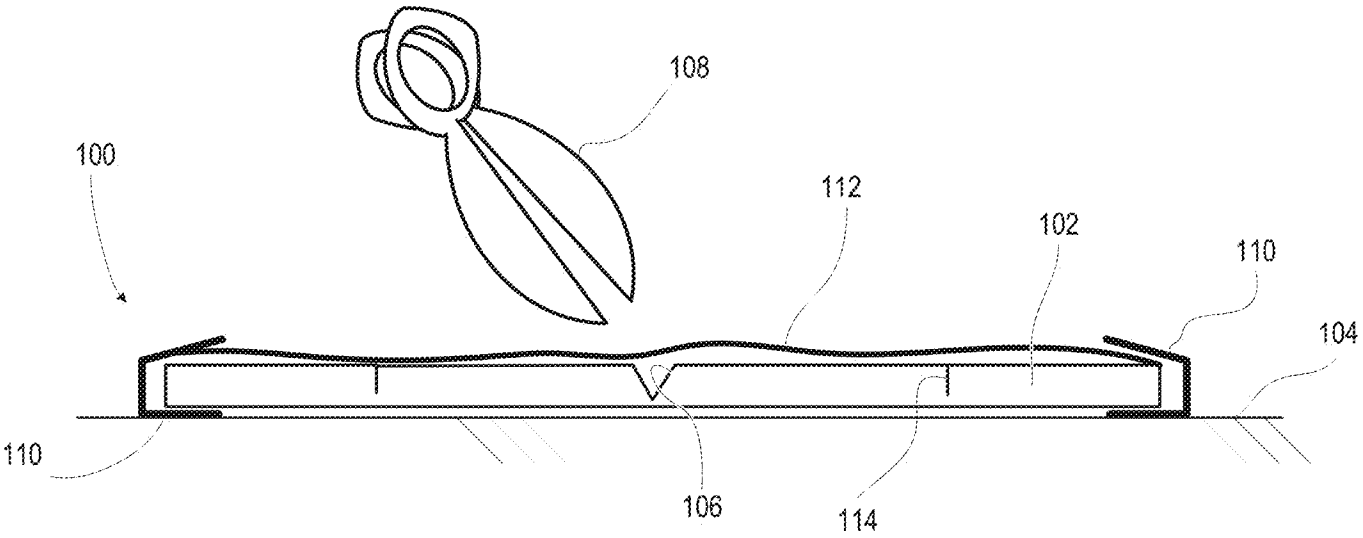
FIG. 2 illustrates a side view of the foldable, tabletop fabric cutting table of FIG. 1, according to one or more embodiments.

FIGS. 1-2 illustrate a portable fabric cutter 100 that is formed of rectangular hoard 102 for use on a table or floor 104 that is light weight and compact for portability and easy storage. FIG. 2 illustrates a central transverse channel forms a scissor guide 106 to guide scissors 108 during the cutting process. Accessories include clips 110 to hold fabric 112 in place. Clips 110 can be detachable or mounted to the board 102. Creases 114 formed in the rectangular platform 102 allow the fabric cutter 100 to fold for easy storage. FIG. 1 illustrates that grid lines 116 are provided to guide the placement of the fabric 112 (FIG. 2).

The length of the fabric cutter 100 can vary from 12 inches up to 60 inches. Width of the fabric cutter 100 can vary from 12 inches up to 48 inches. In some embodiments, the fabric cutter 100 may be about 20" by 24" by 0.25", which is a suitable size for use with fat quarters (about 18" by 21") of fabric.

In an exemplary embodiment, the fabric cutter 100 is 36 inches by 36 inches and formed from a durable material such as polystyrene, polyurethane, plastic, etc., with an integral scissor guide 106 to prevent any breaches between the board 102 and the scissor guide 106. The guide 106 and board 102 may be of sufficient thickness to resist cutting completely through when used with normal cutters 108, such as scissors, rotary cutters, razor knives, and using normal cutting pressure sufficient to comfortably cut all desired layers of fabric.

Grid lines 116 may be provided in any orientation, thickness, scale, frequency, design, pattern, etc., to provide useful reference to an individual using cutting board 102. For example, grid lines 116 may be placed ¼" apart, with heavier lines representing gridlines 116 at each inch. Additionally, angled grid lines 116 may be included at various angles to provide reference for various designs requiring certain angles, or may include circles of various diameters, or other shapes and designs, as desired.

For clarity, the scissor guide 106 is illustrated in the center of the board 102; however, according to certain embodiments a scissor guide can be offset to the left or right or multiple scissor guides can be incorporated. Grid lines 116 can be as small as 4 squares per inch, 3 squares per inch or 2 squares per inch and can be made formed by printing or grooving the surface. US and Metric measurements can be on the side(s) of the cutter. Length of the board 102 can vary from 24 inches up to 60 inches. Width of the board 102 can vary from 12 inches up to 48 inches. Fabric cutter can be a tri-fold, bi-fold, quad-fold, etc. The scissor guide 106 can be symmetrically in the middle. Alternatively, a scissor guide can be at one edge in an asymmetric arrangement. For example, other sizes include 18"×36" asymmetric half-size; 72"×18" symmetric half-size; and 18"×18" asymmetric quarter size.

The grid lines 116 may be etched, painted or otherwise marked on one or both of the board 102 sides, which provides for direct and accurate measurement and setting of the fabric. In one embodiment, the grid lines 116 may be etched into the cutting board 102 using photoluminescent material that absorbs radiant energy and emits light energy. For example, any number of non-radioactive photoluminescent materials could be used including various aluminum oxide ceramic pigments, such as alkaline earth metal aluminate oxide europium doped and alkaline earth metal sulfide europium doped, zinc sulfide, strontium aluminate, or the like. Optionally the photoluminescent material is selected from a photoluminescent material that permits multiple uses, i.e. can absorb radiant energy and discharge light energy over multiple cycles.

Figure 3:
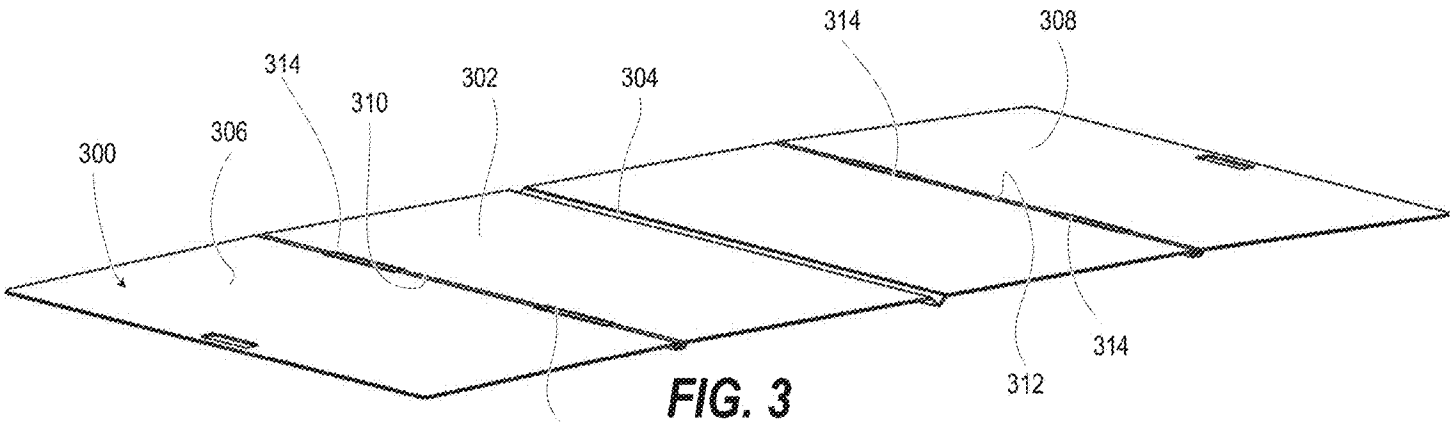
FIG. 3 illustrates a perspective view of an example symmetric full-size board with two folding panels, according to one or more embodiments.
Figure 4:
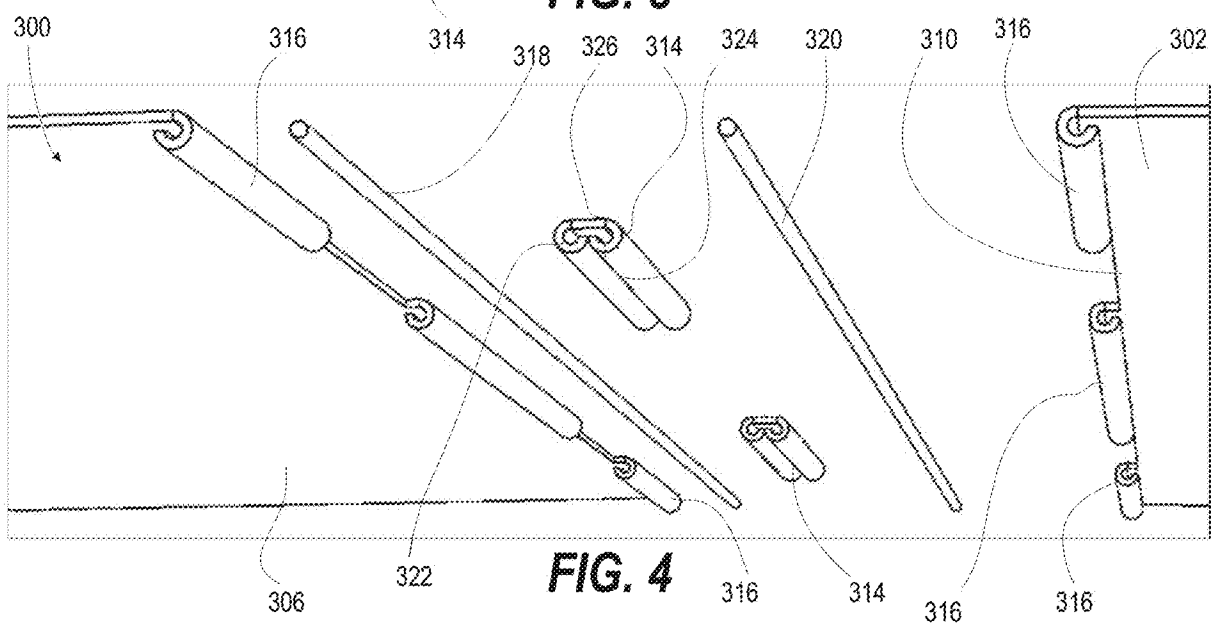
FIG. 4 illustrates an exploded perspective view of a folding hinge assembly of the symmetric full-size board of FIG. 3, according to one or more embodiments.
Figure 5:
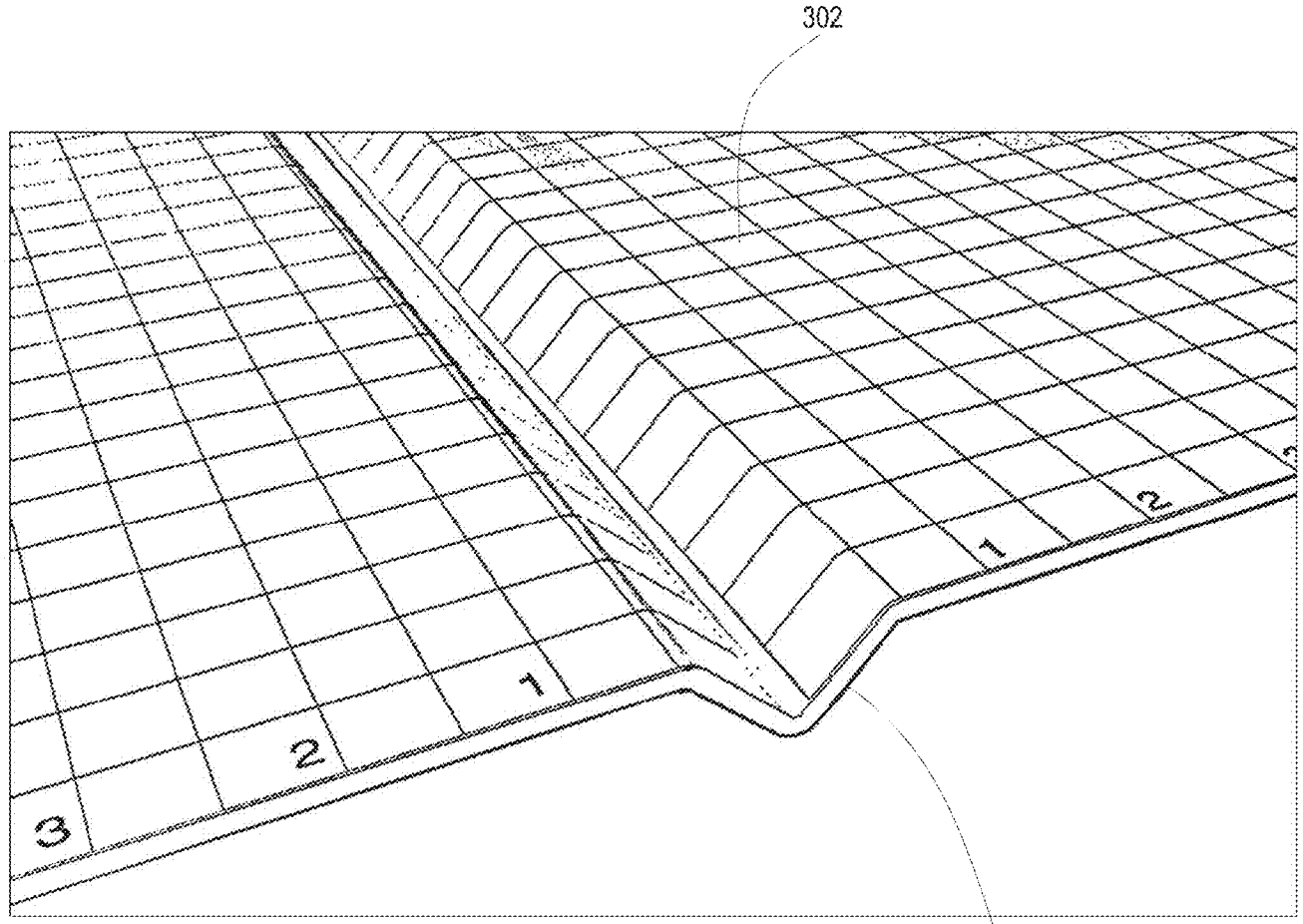
FIG. 5 illustrates a perspective detail view of a V-channel scissor guide of the symmetric full-size board of FIG. 3, according to one or more embodiments.

FIG. 3 illustrates a 72"×36" symmetric full-size board 300 having a 36" wide main panel 302 longitudinally bisected by a V-channel scissor guide 304. Left and right folding panels 306, 308 are attached to left and right sides 310, 312 of the main panel 302 by floating hinges 314. FIG. 4 illustrates the left folding panel 306 and left side 310 of the main panel 302 having corresponding and longitudinally spaced apart pin channels 316 that receive respective hinge pins 318, 320. Each floating hinge 314 has adjacent left and right pin channels 322, 324 attached by a central band 326 that respectively receive hinge pins 318, 320. Each floating hinge 314 longitudinally fits between pin channels 316 of both the left panel 306 and the main panel 302. In an exemplary embodiment, FIG. 5 illustrates that the main panel 302 can be a molded plastic sheet with the V-channel scissor guide 304 formed as a downward molded feature.

Figure 6:
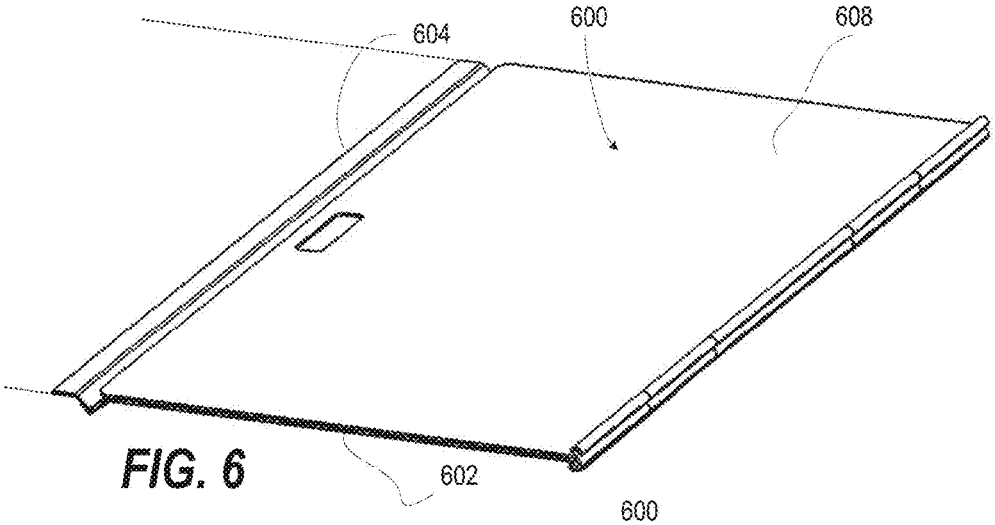
FIG. 6 illustrates a perspective view of an example asymmetric half-size board with a folding panel in a closed position on top of a main panel, according to one or more embodiments.
Figure 7:
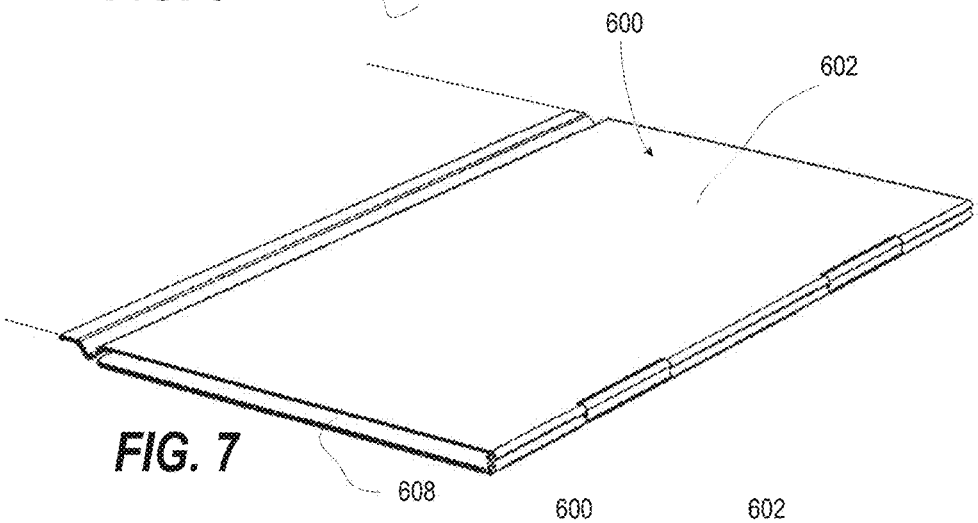
FIG. 7 illustrates a perspective view of the asymmetric half-size board of FIG. 6 with the folding panel in a compact position beneath the main panel, according to one or more embodiments.
Figure 8:
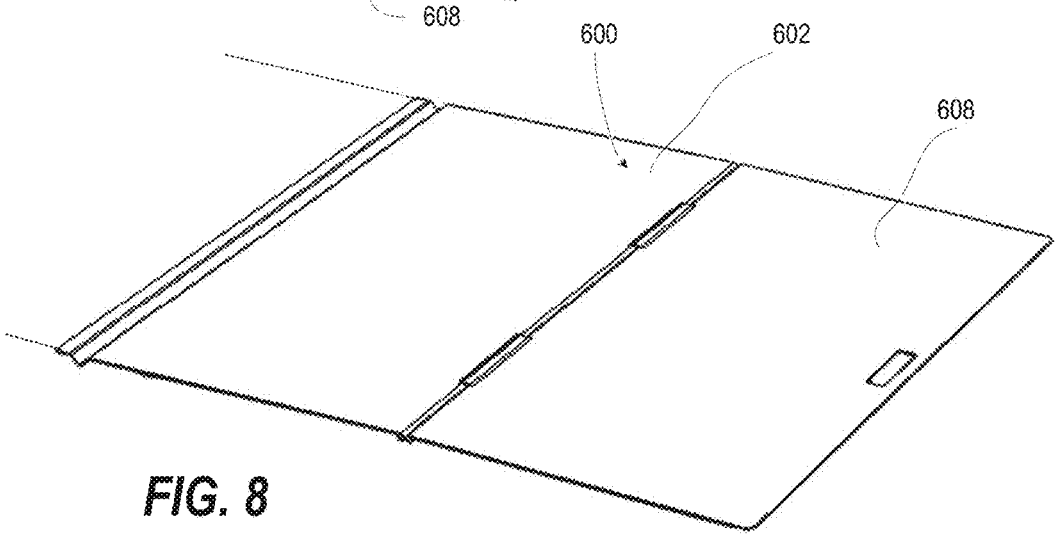
FIG. 8 illustrates a perspective view of the asymmetric half-size board of FIG. 6 with the folding panel in an open, extended position, according to one or more embodiments.

FIGS. 6-8 illustrates a board 600 that can be asymmetric including a V-channel scissor guide 604 and portions of the board 600 to one lateral side, such as a right half side main panel 602 and a right folding panel 608. Alternatively, a main panel extends leftward of the V-channel scissor guide 604 (shown in phantom) with identical folding panel movement on both lateral sides. FIGS. 6-8 illustrates an example of how the right folding panel 602 can be positioned in three different states. FIG. 6 illustrates the right folding panel 608 rotated to a closed position on top of the main panel 602. FIG. 7 illustrates the right folding panel 602 fully rotated an opposite direction to be in a compact position immediately underneath the main panel 602. FIG. 8 illustrates the right folding panel 308 in an intermediate position extending outward from the main panel 602 in an open position.

All fabrics, from the finest silk to the sturdiest upholstery material, are quickly, efficiently, and securely held in place by the fabric cutter 100, until it is cut.

Cutting board 102 may be hung on a vertical surface by attachment points on cutting board 102, or any other suitable hanging device or mechanism. While hung up, such as on a wall, cutting board 102 may be easily stored, or may be used as a useful message board, bulletin board, or other use. For example, cutting board 102 may be hung on a wall and may serve as a message or drawing board, with the ability to post pictures, notes, articles, fabric, etc.

In an exemplary embodiment, the fabric cutter 100 is preferably fabricated from at least partially transparent natural and/or synthetic plastics (e.g., acrylic, polyurethane, polystyrene, etcetera) and/or rubbers, saturated and/or unsaturated rubbers, such as polyisoprene, butyl rubber, polyacrylic rubber, silicones, and fluorosilicones. In some embodiments; cutting board 102 may be formed of translucent, transparent or semi-transparent glycol-modified polyethylene terephthalate (PETG) acrylic plastic. In other embodiments, other transparent or semi-transparent materials such as poly(methyl methacrylate) (PMMA), polycarbonate, other plastics, glass, or other suitable materials may be used. While the fabric cutter 100 has been disclosed for illustrative purposes only as comprising specific materials, other materials are likewise suitable for use in accordance with the present invention, such as cork, wood, metals, alloys, compressed paper products, and/or glass.

In various embodiments, fabric cutter 100 may include a cutting element configured to selectively engage the fabric in the guide 106 of the fabric cutter 100. In some embodiments, the cutting machine may be an ultrasonic cutting machine. In various embodiments, the cutting element may have any suitable configuration for cutting the fabric. In some embodiments, the cutting element 108 of the fabric cutter 100 may be a cutting wheel. The cutting wheel may include one or more ridges on the surface of the wheel for cutting the fabric. The ridges may have any suitable shape, such as straight to form linear cuts in the fabric, or shaped to form non-linear cuts in the fabric. Other embodiments of the cutting system may include another type of cutting element, such as a laser cutter or sharpened blade. The cutting element may be configured to form linear or non-linear (e.g., shaped) cuts.

In one or more embodiments of the present invention, magnets of various sizes, shapes and strengths are used instead of clips, pins or weights to secure a fabric, so that the fabric can be cut accurately and precisely in accordance with the grid or pattern. For this purpose, a magnetically-attractive substrate, such as a plate of magnetic steel, is incorporated into the board 102. As a result, the pattern and/or fabric are clamped between the magnets and the board 102. By "magnetically-attractive" is meant a material that is able to attract a magnet or be attracted by a magnet. In one or more embodiments, the magnetically-attractive substrate includes a top layer of a resilient or other material that is well-suited to receive a sharp edge, such as that of a knife, razor, or cutting wheel, to produce a clean cut in the fabric.

In one or more embodiments of the present invention, the top and/or bottom surfaces of the board 102 may be at least partially covered with anti-microbial, anti-bacterial, anti-viral, and/or combinations thereof, coatings or agents. In accordance with the present invention, anti-microbial agents comprise chemical compositions that at least substantially inhibit microbial growth and/or kill bacteria, fungi and/or other microorganisms. A plurality of inorganic and/or organic chemical compositions which display anti-microbial activity are suitable for use with the present invention. Non-limiting examples of suitable organic substances that possess anti-microbial activity are carboxylic acids, alcohols and/or aldehydes.

In one or more embodiments of the present invention, the board 102 may incorporate one or more alignment light beams from light emitting devices (lasers) for alignment of fabric and measuring. As will be appreciated, in alternative embodiments, the light beams may be provided by other light emitting devices, for example, IR devices, LED's, etc. and cutting. In the described embodiment, light emitting devices project respective light beams that illuminate lines of light on the fabric. As will be appreciated, in other embodiments, other lasers may be used, for example, lasers that project a spot or a short line of light may also be used. In such an embodiment, a light emitting device can be used to project a spot of light at any point along the cutting path. Such spot is used to identify when an indicium is marked on the fabric.

Embodiments herein provide a cutting system for cutting a fabric. In various embodiments, a stabilizing material may be disposed on one or both sides of the fabric during the cutting operation. The stabilizing material may prevent/reduce stretching/elongation of the fabric to facilitate achieving precise cutting dimensions (e.g., cutting length). The stabilizing material may be any suitable material, such as paper and/or fabric. In some embodiments, the stabilizing material may be more rigid than the fabric to be cut. Additionally, or alternatively, the stabilizing material may have a low coefficient of friction to allow the stabilizing material to slide relative to the fabric, thereby preventing/reducing stretching of the fabric. The stabilizing material may be cut during cutting of the fabric.

In one or more embodiments, left and right folding panels can be about the same size as a main panel, allowing a compact state of about ⅓ of the width of the fully unfolded, open state. In one or more embodiments, each folding panel can have a respective additional folding panel extending outward therefrom to allow a further lateral width while preserving a same compact width for storage.

Figure 9:
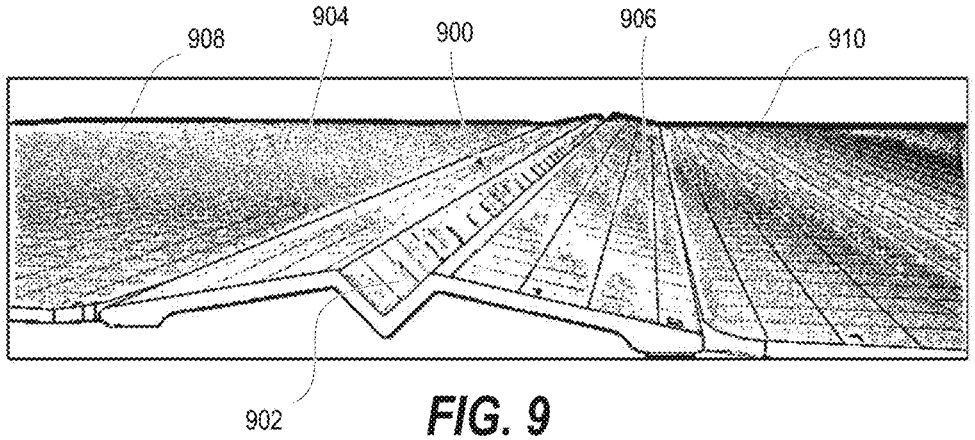
FIG. 9 illustrates a side perspective view of an example fabric cutting board that includes two fabric mats, according to one or more embodiments.
Figure 10:
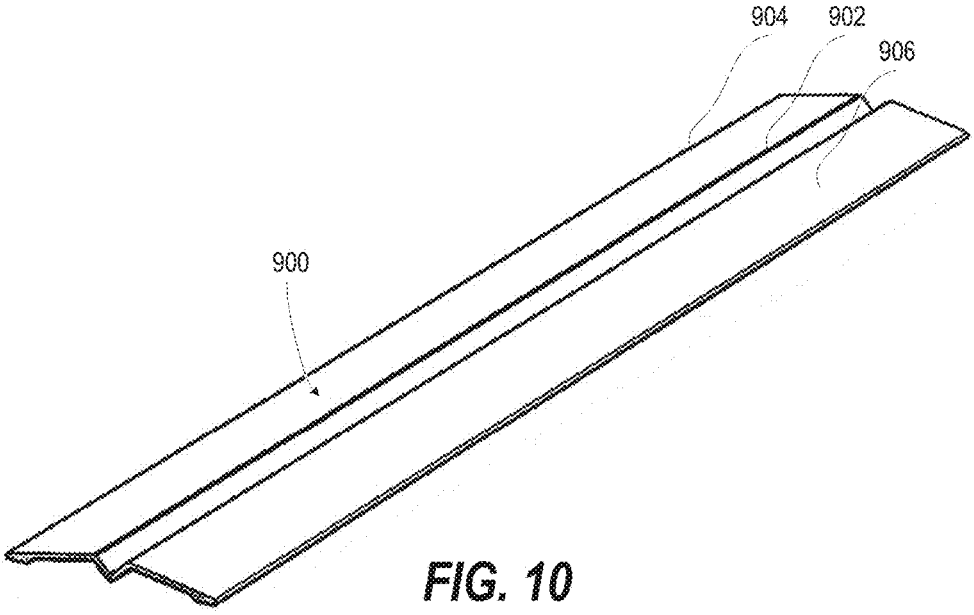
FIG. 10 illustrates a top perspective view of a central V-shaped cutting guide of the fabric cutting board of FIG. 9, according to one or more embodiments.
Figure 11:
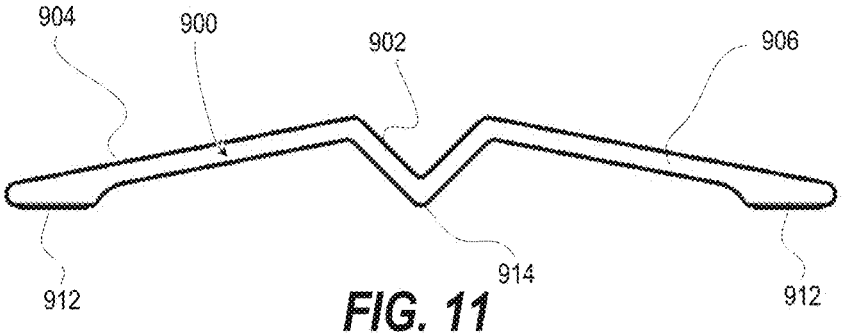
FIG. 11 illustrates a side view of the example fabric cutting board of FIG. 9, according to one or more embodiments.

FIGS. 9-11 illustrate a fabric cutting board 900 that is rectangular when viewed from above. The fabric cutting board 900 has an integral V-shaped scissor guide 902 formed across an upper surface. Left and right panels 902, 904 are attached longitudinally along each side of the integral V-shaped scissor guide 902. Each panel 904, 906 is sloped from a height of the integral V-shaped scissor guide 902 down to a mat thickness. FIG. 9 illustrates left and right fabric mats 908, 910 that positioned respectively against the outer longitudinal edge of the left and right panels 902, 904. FIG. 11 illustrates that the outer longitudinal edges of each panel 904, 906 have foot portion 912 and a longitudinal central low point 914 of the integral V-shaped scissor guide 902 are supportable on a horizontal surface 916. In one or more embodiments, the fabric mat 908, 910 can be detached and positionable respectively against the outer longitudinal edge of the left and right panels 904, 906. In one or more embodiments, the fabric mat 908, 910 can be adhered, attached or engaged to the left and right panels 904, 906.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

While it is apparent that the illustrative embodiments of the invention herein disclosed fulfill the objectives stated above, it will be appreciated that numerous modifications and other embodiments may be devised by one of ordinary skill in the art. Accordingly, it will be understood that the appended claims are intended to cover all such modifications and embodiments, which come within the spirit and scope of the present invention.

What is claimed is:

1. A fabric cutting board comprising:

a rectangular board having an integral scissor guide formed across an upper surface;

measurement grid presented on the upper surface; and at least two rectangular channel clips sized to grip a lateral edge and adjacent top and bottom edges on respective opposite sides of the rectangular board, clamping a layer of fabric against the upper surface.

2. The fabric cutting board of claim 1, wherein the rectangular board comprises:

a main panel including the V-channel scissor guide; and a first folding panel hingedly attached to the main panel to move between:

(i) a compact position folded against the main panel; and (ii) an open position extending outward away from the main panel.

3. The fabric cutting board of claim 2, further comprising a floating hinge hingedly attached between the main panel and the first folding panel, wherein the first folding panel is movable between (i) a first compact position folded on top of the main panel; (ii) a second compact position folded beneath the main panel; and (iii) the open position extending outward away from the main panel.

4. The fabric cutting board of claim 2, further comprising a second folding panel hingedly attached to an opposite lateral side of the main panel to move between:

(i) a compact position folded against the main panel; and (ii) an open position extending outward away from the main panel.

5. A fabric cutting board comprising:

a rectangular board having an integral V-shaped scissor guide formed across an upper surface; and left and right panels attached longitudinally along each side of the integral V-shaped scissor guide, each panel sloped from a height of the integral V-shaped scissor guide down to a mat thickness that is less than the height of the integral V-shaped scissor guide, wherein at least an outer longitudinal edge of each panel and a longitudinal central low point of the integral V-shaped scissor guide are supportable on a horizontal surface.

6. The fabric cutting board of claim 5, further comprising a fabric mat positioned against the outer longitudinal edge of a selected one of the left and right panels, wherein the rectangular board and left and right panels are longitudinally elongate.

7. The fabric cutting board of claim 5, wherein the V-shaped scissor guide and at least adjacent portions of the left and right panels have a constant thickness, a respective undersurface of each of the left and right panels sloping upward toward attachment with the V-shaped scissor guide.

8. The fabric cutting board of claim 1, wherein at least two rectangular channel clips are detachable from the rectangular board.

* * * * *